US005594956A

United States Patent [19]

Barrientos

[11] Patent Number: 5,594,956

[45] Date of Patent: Jan. 21, 1997

[54] HEAD BANDANNA HAVING A HEADBAND WITH CLOSURE TABS

[75] Inventor: Heriberto M. Barrientos, Elizabeth, N.J.

[73] Assignee: Rags N' Things Inc., Linden, N.J.

[21] Appl. No.: 429,333

[22] Filed: Apr. 26, 1995

[51] Int. Cl.[6] ..... A42B 1/06

[52] U.S. Cl. ..... 2/207; 2/171; 2/172

[58] Field of Search ..... 2/171, 172, 175.1, 2/181, 195.1, 195.7, 195.8, 202, 203, 207, DIG. 11

[56] References Cited

U.S. PATENT DOCUMENTS

| | | | |
|---|---|---|---|
| 430,003 | 6/1890 | De Lacy | 2/171 |
| 2,856,607 | 10/1958 | Richardson | 2/172 |
| 4,491,985 | 1/1985 | Dalton | 2/171 |
| 4,499,741 | 2/1985 | Harris | 2/DIG. 11 |
| 5,161,260 | 11/1992 | Reynolds | 2/171 |

FOREIGN PATENT DOCUMENTS

| | | | |
|---|---|---|---|
| 2262928 | 10/1975 | France | 2/175.1 |

*Primary Examiner*—Diana Biefeld
*Attorney, Agent, or Firm*—Ezra Sutton

[57] ABSTRACT

A head bandanna is provided for protecting and covering the head area, which is used in sporting, recreational and work activities and includes a head covering made of fabric having a front and a rear portion, wherein the front portion has a front curved edge substantially in the shape of a semicircle. There is also a curved headband made of absorbent material and having the shape of a longitudinal strip and being integrally connected to the front curved edge of the front portion of the head covering at a 90° angle facing downwardly relative to the headband. Velcro closure tabs are connected to opposite ends of the headband for fitting the head bandanna on the wearer's head in a conforming and secure fit.

25 Claims, 6 Drawing Sheets

HEAD BANDANNA HAVING A HEADBAND WITH CLOSURE TABS

FIELD OF THE INVENTION

This invention relates to a new type of head covering or headwear, and more particularly, this invention relates to headwear having an integral, curved headband and a head-covering portion which fits securely on the wearer's head and which is especially useful for athletic, recreational, or heavy work activities.

BACKGROUND OF THE INVENTION

Headwear or head coverings for work, sporting activities, or casual dress have taken many forms in relation to style, appearance, shapes, functionality, and types of materials used. Such headwear or head coverings have been in the forms of kerchiefs, bandannas, scarves, turbans, visor caps, beanies, helmets, and the like. Generally, these types of headwear or head coverings are used to protect the wearer's head from the sun, dirt/grime, and debris; and also, at certain times, they serve as sweatbands during vigorous athletic or work activities, absorbing the wearer's perspiration from the head and brow areas. There remains a need for a head covering that securely fits and conforms to the head and brow area and has an integral and curved headband for absorbing perspiration or grime from the brow area while also being effective in protecting the wearer's head and hair from the elements of sun, heat, cold, dirt, and the like.

DESCRIPTION OF THE PRIOR ART

Headwear or head coverings of various designs, styles, and materials of construction have been disclosed in the prior art. For Example, U.S. Pat. No. 5,161,260 to Reynolds discloses athletic headwear having a square-shaped body portion and a straight elastic headband which is positioned on the brow of the head to retain sweat from an absorbent sweat pad. The headband has closure means in the form of hook and loop fastener pads or a hook and loop for fastening the headwear to the user's head and brow.

U.S. Pat. No. 5,062,157 to Muta discloses a rectangular headband towel having inner and outer surfaces, and extended headband strips having hook and loop fastener-fastening means. The head-covering portion of the headband towel covers the head, neck, and upper shoulders of the wearer in a loose form.

U.S. Pat. No. 5,048,128 to Watson discloses protective headwear having an integrally-connected rectangular kerchief portion, a crescent-shaped visor, and a ribbon, which can be knotted at a suitable tension to secure the headwear to the wearer's head. A major portion of the headwear drapes in loose folds on the wearer's head, neck, and shoulders.

None of the prior art patents, however, discloses headwear or a head covering of a head bandanna having a curved headband integrally connected to a curved head-covering portion. Also, none of the prior art discloses a head bandanna that fits securely and conforms to the wearer's head with a minimum amount of folds and creases to the head covering portion when in use.

Accordingly, it is an object of the present invention to provide a head bandanna having a curved headband integrally connected to a curved head-covering portion which protects the wearer's head and hair from heat, cold, sun, dirt, grime, rain, wind, and the like.

Another object of the present invention is to provide a head bandanna that has a headband which is used for securing the head bandanna to the wearer's brow by using hook and loop fastener closure tabs to provide a secure and conforming fit.

Another object of the present invention is to provide a head bandanna that is made of an easy-to-clean fabric material of various designs, which is lightweight and breathable for enhancing the wicking away of moisture from the wearer's head for evaporation, when used for sporting, recreational, or work activities.

Another object of the present invention is to provide a head bandanna that fits securely, conforms to the wearer's head and hair, when secured around the forehead, such that there is a minimum amount of folds and creases to the head-covering portion when in use during any type of work, sporting or recreational activities. This gives the head bandanna a neat and unwrinkled appearance on the wearer's head when in use during the aforementioned activities.

Another object of the present invention is to provide a head bandanna which may be worn in various configurations.

Another object of the present invention is to provide a head bandanna that is convenient to carry, easy to use, and secure and comfortable to wear by children and adults of both sexes.

An even further object of the present invention is to provide a head bandanna that can be mass produced in an automated and economical manner and being readily affordable by the consumer.

SUMMARY OF THE INVENTION

In accordance with the present invention, there is provided an improved head bandanna having a head covering attached to a headband having hook and loop fastener closure tabs that may be used for many types of sporting, recreational, and/or work activities. The present invention provides for a head bandanna having a curved, tear-shaped, head covering integrally attached to a headband, at a 90° angle, for positioning the bandanna on the brow of the wearer's head.

Attached to opposite ends of the headband are hook and loop fastener tabs for securing the head bandanna firmly to the wearer's head at the back of the upper neck section having a minimum amount of folds and creases to the head-covering portion when in use.

The head bandanna is made of an easy-to-clean fabric material of various designs and colors which can also be lightweight and waterproof. The fabric materials can be made of linen, cotton, nylon, rayon, silk, polyester, polypropylene, leather, fur, or the like. The bandanna can be printed with various designs of logos, team names, animal characters, movie/TV personalities, printing indicia, lace or flower patterns, and the like. Such variations of designs to the head bandanna enhance the appearance of the wearer. The head bandanna can be worn by adults and children of both sexes having a variety of sizes for use.

BRIEF DESCRIPTION OF THE DRAWINGS

Further objects, features, and advantages of the present invention will become apparent upon consideration of the detailed description of the presently-preferred embodiments, when taken in conjunction with the accompanying drawings, wherein.

DETAILED DESCRIPTION OF THE PREFERRED EMBODIMENTS

Figure 2:
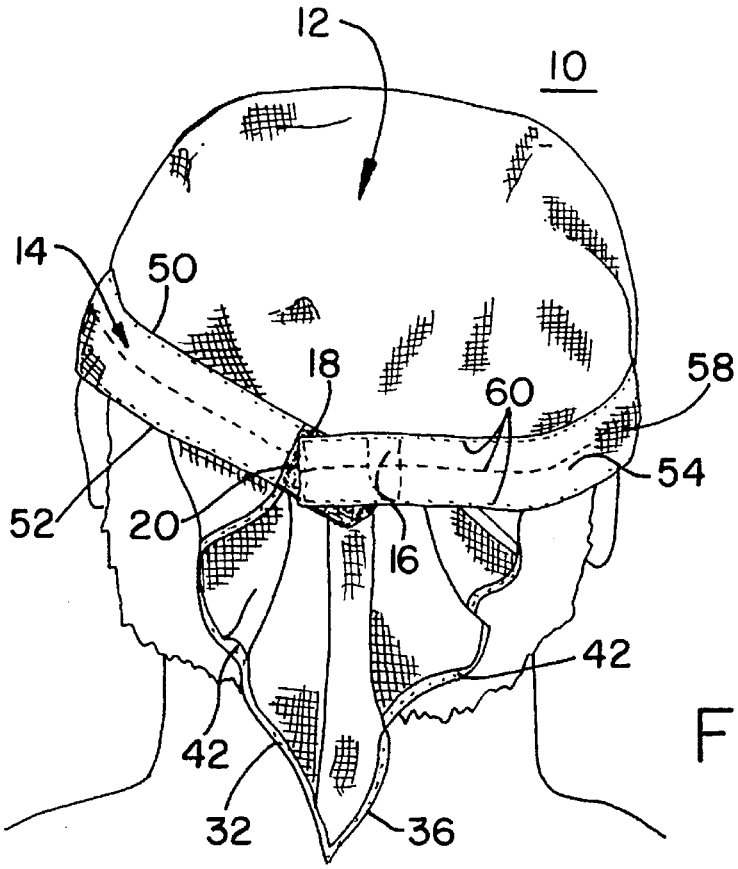
FIG. 2 is a rear perspective view of the head bandanna showing the head-covering, with the tail-end portion being tucked inside closed hook and loop fastener tabs.
Figure 3:
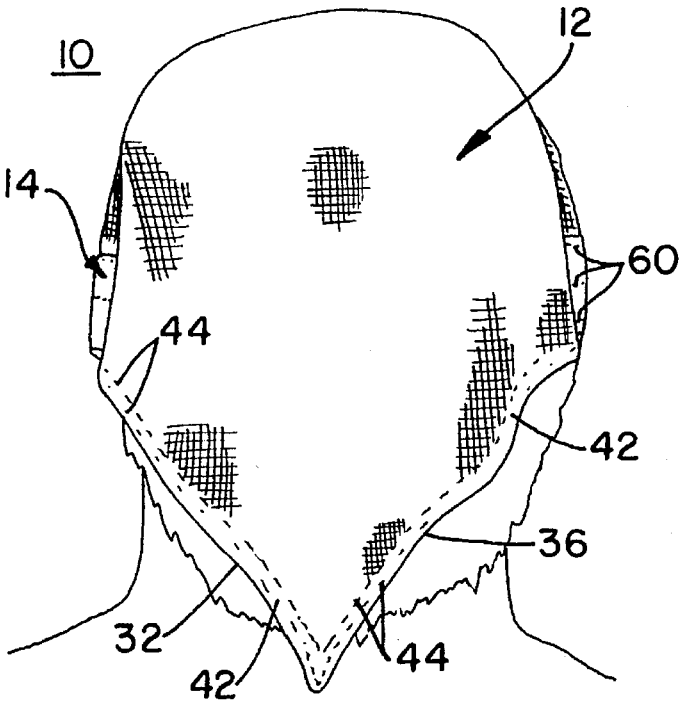
FIG. 3 is a rear perspective view of the head bandanna showing the head-covering, with the tail-end portion outside the closed hook and loop fastener tabs.
Figure 4:
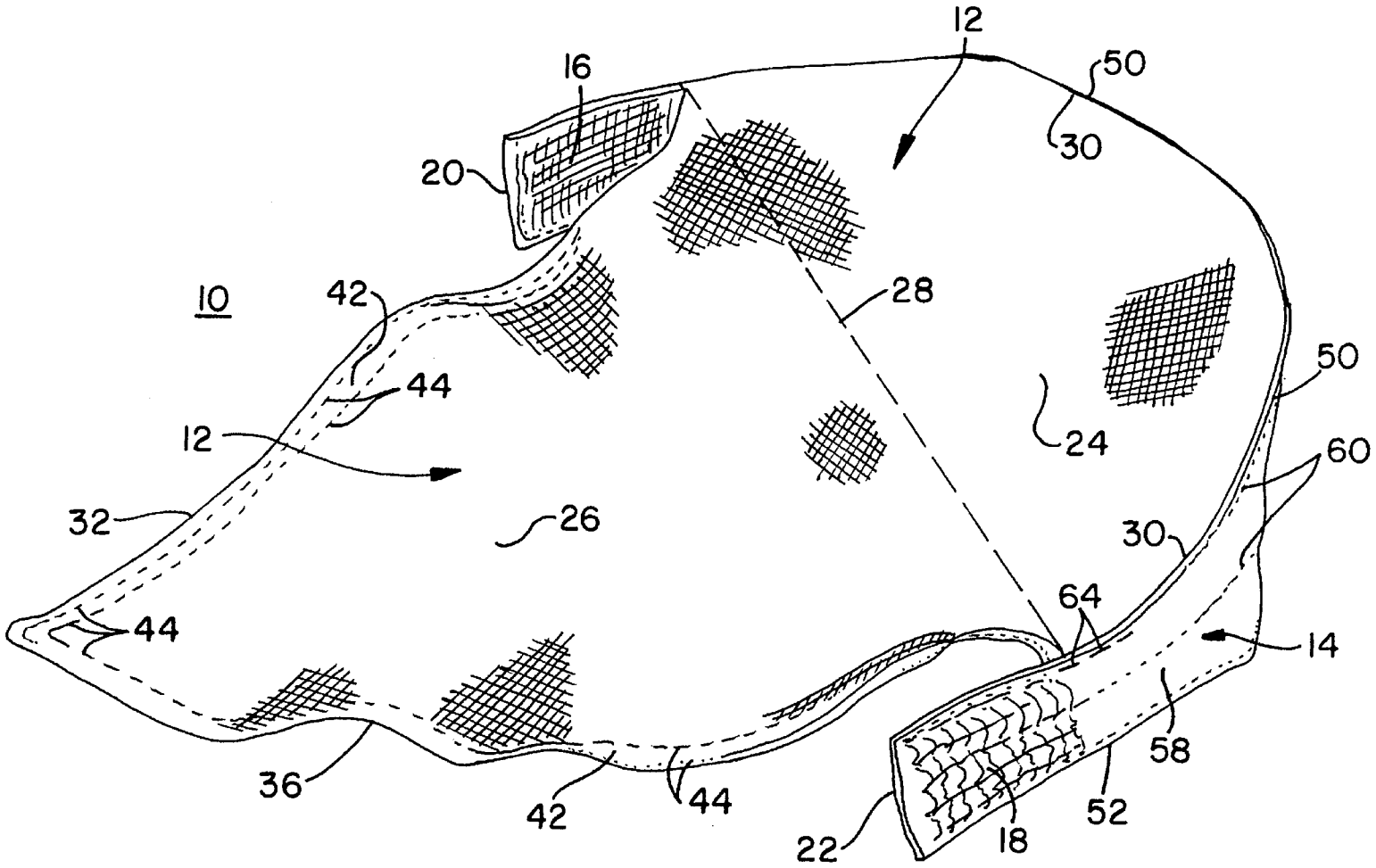
FIG. 4 is a top (outer surface) perspective view of the head bandanna showing a teardrop shaped, head-covering portion in a spread-opened position.
Figure 5A:
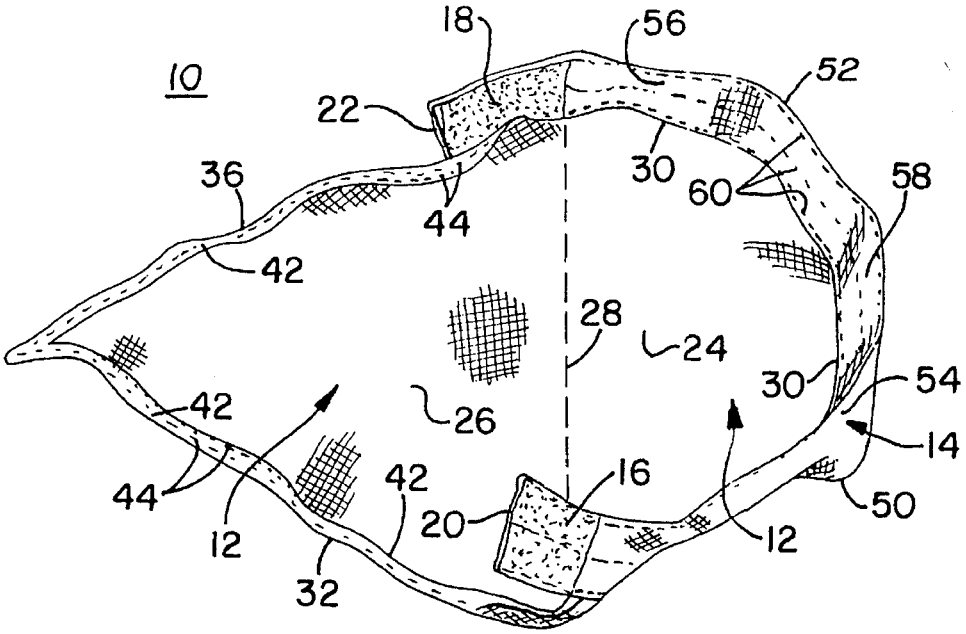
FIG. 5A is an inside surface perspective view of the head bandanna showing a teardrop shaped, head-covering portion in a spread-opened position.

The head bandanna 10 and its component parts of the preferred and alternate embodiments of the present invention are represented in detail by FIGS. 1 through 9. The head bandanna 10 comprises a curved, tear-shaped head covering 12 being integrally attached to an absorbent, rectangular headband 14, having hook and loop fastener closure tabs 16 and 18 attached to opposite ends 20 and 22 of headband 14, as depicted by FIGS. 4 and 5 of the drawings. The head covering 12 includes a front portion 24 and a rear portion 26, and for ease of description, these two portions have been separated by dotted line 28. The front portion 24 is semicircular in shape, having a curved perimeter front edge 30. The rear portion 26 is triangular in shape, having two side perimeter edges 32 and 36. The side perimeter edges 32 and 36 each have a small folded-over fabric edge 42 being held in place by means of stitching 44, gluing (not shown), or stapling (not shown).

The rear portion 26 of head covering 12 can come in various shapes, such as triangular, rectangular, square, semicircular, semioval, polygonal, and the like. The rear portion 26 can have perimeter edging that is scalloped, triangular serrated, square-toothed, or the like. The perimeter edging can have various attachments, such as fringes, tassels, bows, tied and knotted string elements, and the like. Alternate embodiments will be discussed below, having some of the aforementioned shapes and designs of rear portion 26.

Head covering 12 and headband 14 of head bandanna 10 may be made of various fabric materials, such as linen, cotton, nylon, rayon, silk, polyester, polypropylene, leather, fur, plastic, rubber, and the like. The head bandanna 10 can be printed with various designs, such as corporate logos, team names, animal caricatures, movie/TV personalities, printed indicia 46 and 62, lace or flower patterns, and the like. These various designs can be printed on the head covering 12 and/or the headband's exterior surface area of bandanna 10.

The head bandanna 10 can be made adaptable to various weather and/or environmental conditions, such that the bandanna 10 can be made of waterproof materials like rubber or plastic, which protects against rain or snow, or made of a non-woven spun-bonded polypropylene fabric material, which protects against chemicals in the air, or spattering of paint on the wearer, etc.

The sizing of head covering 12 for adults would have an approximate preferred width measurement of 13 inches and a length measurement of 21 inches, giving a head-covering area of approximately 160 square inches. The head covering's overall width measurement has a range of 9 inches to 13 inches, and the overall length measurement has a range of 15 inches to 21 inches.

Headband 14 is in the shape of a longitudinal strip, having upper and lower perimeter edges 50 and 52 and an exterior and interior surface area 54 and 56. Headband 14 is made by having multilayers of the fabric folded over into the longitudinal strips for headband durability, strength, and absorbency. The folded-over fabric 58 is held in place and reinforced by means of multiple longitudinal lines of stitching 60, as shown in FIGS. 4 and 5. The folded-over fabric 58 may also be held in place by means of gluing or stapling.

The headband 14 may also contain a second fabric material (not shown) within the folded-over fabric layers 58 to give additional durability, strength, and/or absorbency (sweat pad) to headband 14.

Figure 5B:
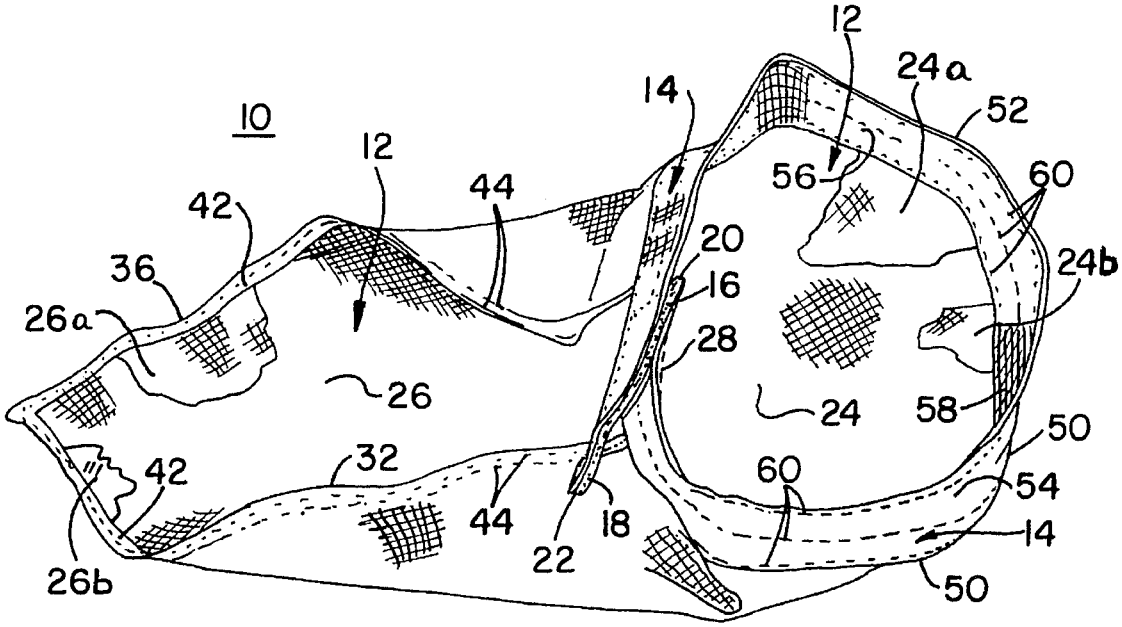
FIG. 5B is an inside surface perspective view of the head bandanna showing a teardrop shaped, head-covering portion in a closed position (closed hook and loop fastener tabs)

For example, as shown in FIG. 5B, the folded fabric 58 of headband 14 can be made of terry cloth for extra absorbency for absorbing heavy amounts of perspiration from work or sporting activities. In addition, sections 24 and 26 may be lined with an additional layer 24*a* and 26*a* of terry cloth or other absorbent material to increase absorbency. Alternatively, additional layer 24*b* and 26*b* may be used to make the bandana 10 reversible for wearing inside out.

The headband 14 has a width measurement of 1½ inches, with a range in width of 1 inch to 3 inches and a length measurement of 25 inches, with a range of 15 inches to 30 inches in length, depending upon the use by an infant, child, or adult.

To form the headband 14 into a curved shape, as depicted in FIGS. 4 and 5, the upper perimeter edge 50 of headband 14 is integrally attached at a 90° angle, pointing downwardly, as shown in FIG. 4, to the curved perimeter edge 30 of head covering 12 by means of reinforced stitching 64, gluing, or stapling. The head bandanna 10 can be easily folded into a small sized packet for carrying in a pocket, handbag, and the like.

Closure tabs 16 and 18, made of hook and loop fastener, are placed at opposite ends 20 and 22 of headband 14, as depicted in FIGS. 4 and 5. The left closure tab 16 is secured to the headband's exterior surface 54 at end 20 by means of reinforced stitching 60. The right closure tab 18 is secured to the headband's interior surface 56 at end 22 by means of reinforced stitching 60. Alternate closure means can be simple hook and eyes (not shown), or buckle and strap configurations (not shown), or plastic and metal snaps (not shown) being attached to the ends 20 and 22 of headband 14.

DETAILED DESCRIPTION OF ALTERNATE EMBODIMENTS

Alternate embodiments of head bandannas of the present invention are depicted in FIGS. 6, 7, 8, and 9. All aspects of these alternate head bandannas 100, 200, 300, and 400 are the same as the preferred embodiment of head bandanna 10, except for the shape, design pattern, or perimeter edging of the rear portion 26 of head covering 12, which are different.

Second Embodiment 100

Figure 6:
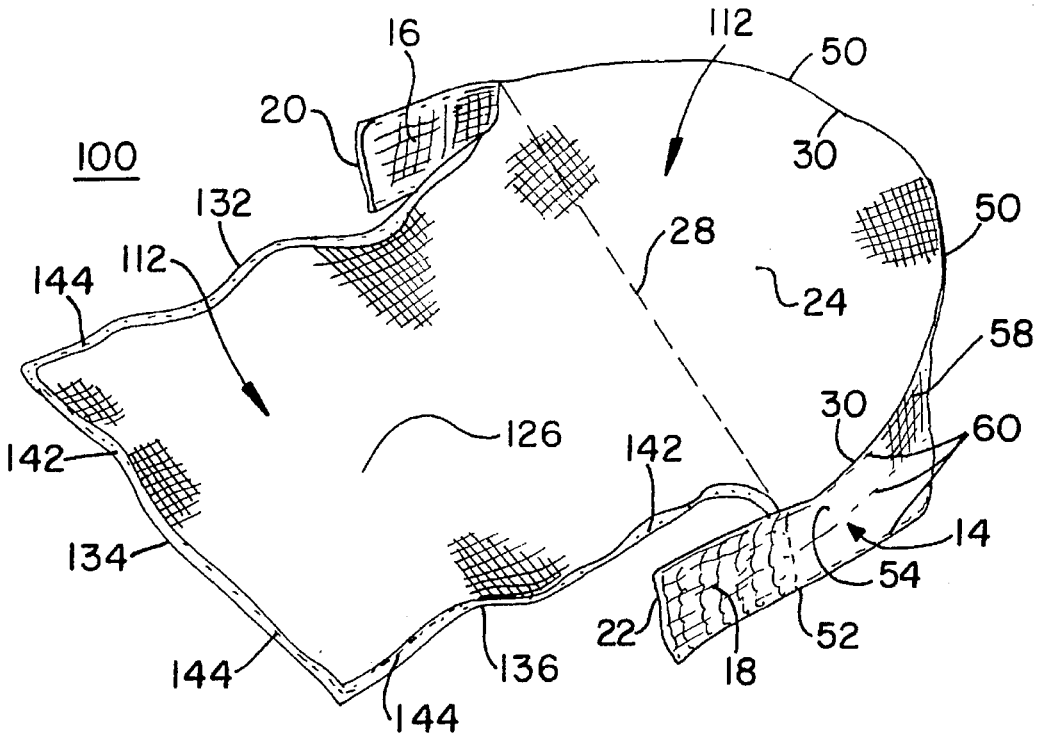
FIG. 6 is a top perspective view of a second embodiment of a head bandanna showing a rectangular head-covering, with the tail-end portion in a spread-opened position.

The head bandanna 100 and its component parts of the second embodiment are represented in FIG. 6. Head bandanna 100 has a rear portion 126 of head covering 112 in the shape of a rectangle having side perimeter edges 132, 134, and 136. The small folded-over fabric edges 142 of side perimeter edges 132, 134, and 136 are held in place by means of stitching 144.

Third Embodiment 200

Figure 7:
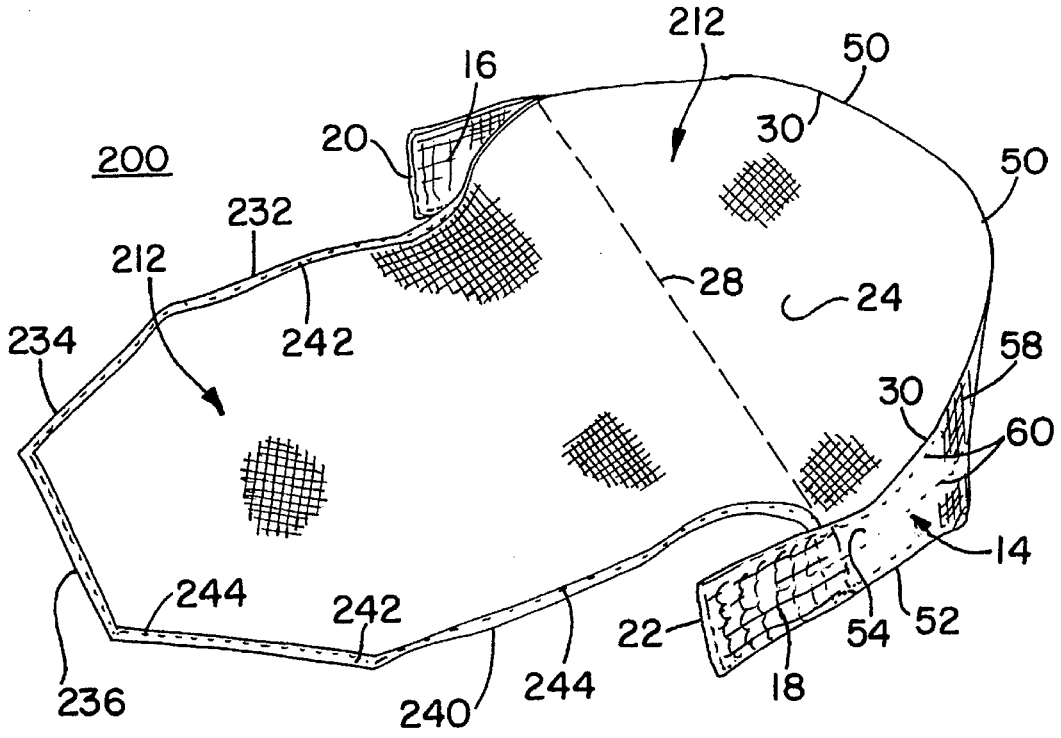
FIG. 7 is a top perspective view of a third embodiment of a head bandanna showing a polygonal head-covering portion in a spread-opened position.

The head bandanna 200 and its component parts of the third embodiment are represented in FIG. 7. Head bandanna 200 has a rear portion 226 of head covering 212 in the shape of a polygon, having side perimeter edges 232, 234, 236, 238, and 240. The small folded-over fabric edges 242 of side perimeter edges 232 through 240 are held in place by means of stitching 244.

Fourth Embodiment 300

Figure 8:
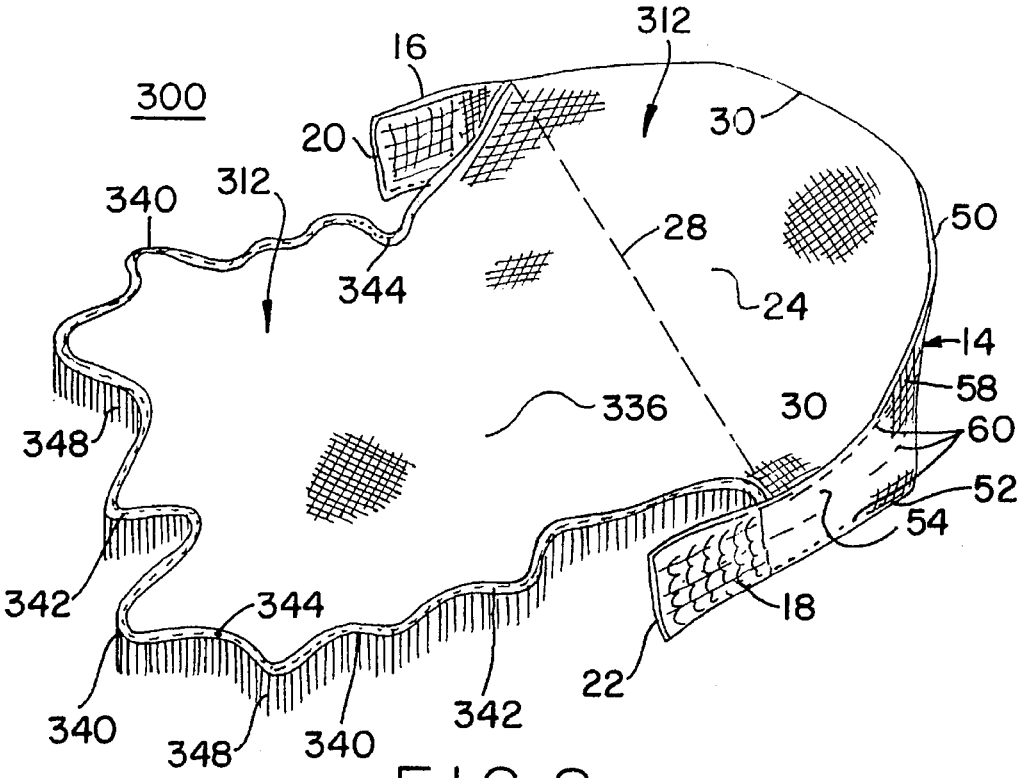
FIG. 8 is a top perspective view of a fourth embodiment of a head bandanna showing a scalloped perimeter edge having a plurality of fringes on the tail-end portion in a spread-opened position.

The head bandanna 300 and its component parts of the fourth embodiment are represented in FIG. 8. Head bandanna 300 has a rear portion 336 of head covering 312, having a scalloped perimeter edge 340. The small folded-over fabric edge 342 of scalloped perimeter edging 340 and a plurality of fringed material 348, being attached to perimeter edging 340, are held in place by means of reinforced stitching 344.

Fifth Embodiment 400

Figure 9:
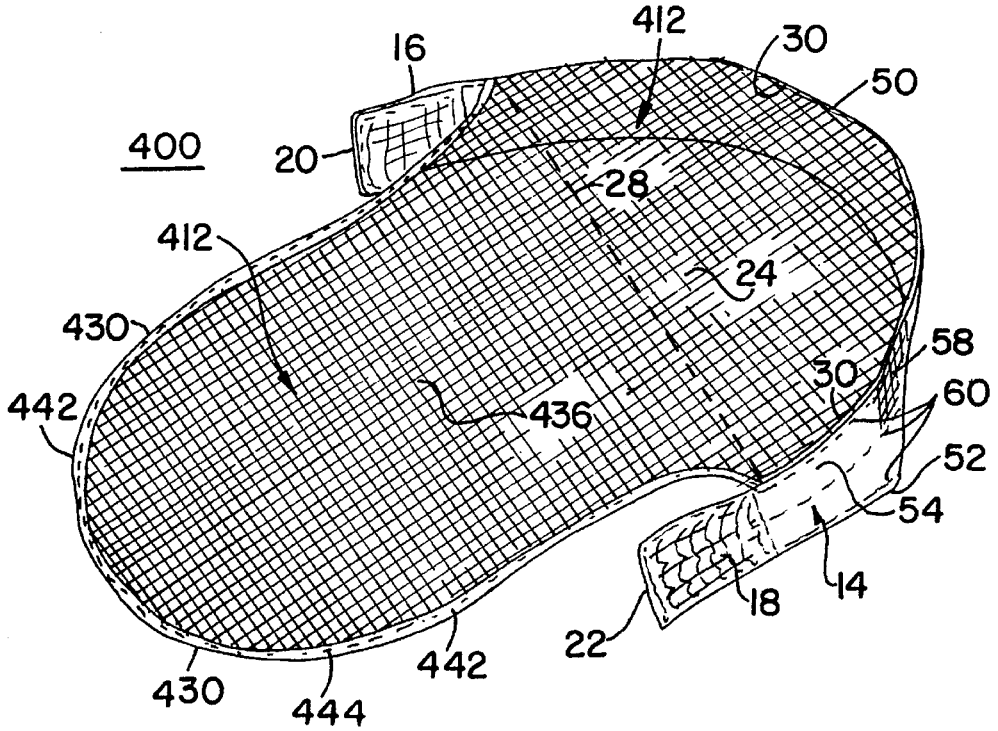
FIG. 9 is a top perspective view of a fifth embodiment of a head bandanna showing an oval head-covering portion having a lace pattern in a spread-opened position.

The head bandanna 400 and its component parts of the fifth embodiment are represented in FIG. 9. Head bandanna 400 has a rear portion 436 of head covering 412 in the shape of a semioval, having a curved perimeter edge 430. The small folded-over fabric edging 442 of curved perimeter edging 430 is held in place by means of reinforced stitching 444. The head bandanna 400 fabric is of a lace pattern and style.

METHOD OF OPERATION OF THE PRESENT INVENTION

In operation, the wearer unfolds the head bandanna 10 and places the interior surface side 56 of headband 14 on the brow/forehead of the wearer's head and the head covering 12 on top of the hair/head area of the wearer. The wearer, then using his/her left and right hands behind his/her neck, closes the hook and loop fastener tabs 16 and 18 of headband 14 to give the wearer a firm and conforming fit with a minimal amount of folds and/or creases to the head-covering portion 12.

Figure 1:
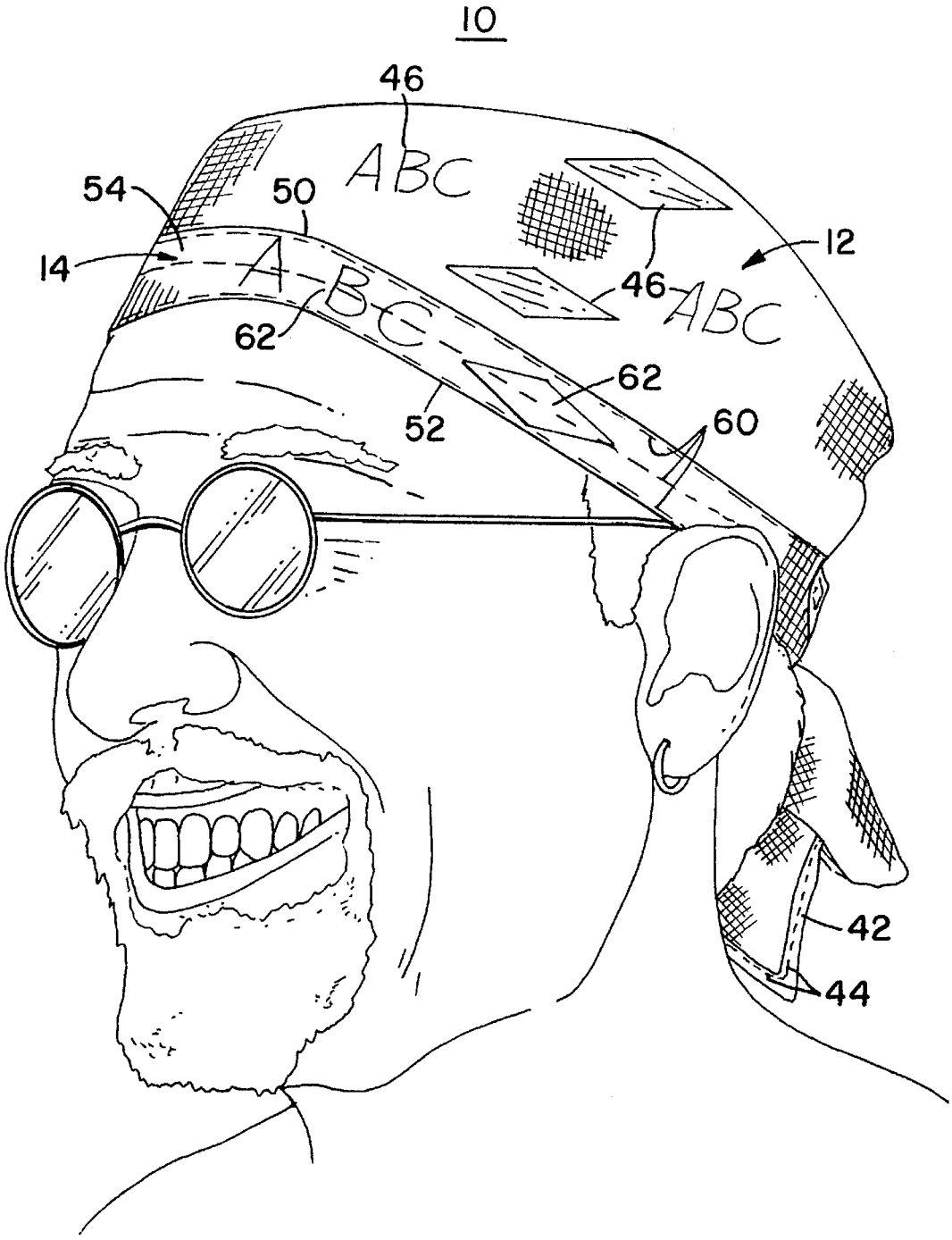
FIG. 1 is a frontal perspective view of the present invention of the head bandanna being in a secure and conforming fit on the wearer's head.

The wearer of head bandanna 10 has various choices of configuration, style, and appearance by simply adjusting the rear (tail) portion 26 of head covering 12 by having it tucked in or left out or folded over without the tail portion showing, as depicted by FIGS. 1, 2, and 3 of the drawings showing the head bandanna on a wearer's head.

ADVANTAGES OF THE PRESENT INVENTION

Accordingly, it is an advantage of the present invention that it provides a head bandanna having a curved headband integrally connected to a curved head-covering portion which protects the wearer's head and hair from heat, cold, sun, dirt, grime, rain, wind, and the like.

Another advantage of the present invention is that it provides a head bandanna that has a headband which is used for securing the head bandanna to the wearer's brow by using hook and loop fastener closure tabs to provide a secure and conforming fit.

Another advantage of the present invention is that it provides a head bandanna that is made of an easy-to-clean fabric material of various designs, which is lightweight and breathable for enhancing the wicking away of moisture from the wearer's head for evaporation, when used for sporting, recreational, or work activities.

Another advantage of the present invention is that it provides a head bandanna that fits securely, conforms to the wearer's head and hair, when secured around the forehead, such that there is a minimum amount of folds and creases to the head-covering portion when in use during any type of work, sporting or recreational activities. This gives the head bandanna a neat and unwrinkled appearance on the wearer's head when in use during the aforementioned activities.

Another advantage of the present invention is that it provides a head bandanna which may be worn in various configurations.

Another advantage of the present invention is that it provides a head bandanna that is convenient to carry, easy to use, and secure and comfortable to wear by children and adults of both sexes.

A further advantage of the present invention is that it provides a head bandanna that can be mass produced in an automated and economical manner and being readily affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A head bandanna to be worn on the head area of a wearer for protecting and covering the head area, which is used in sporting, recreational and work activities, comprising:

a) a head covering made of fabric having a front and a rear portion, wherein said front portion has a front curved edge substantially in the shape of a semicircle;

b) a curved headband made of absorbent material and having the shape of a longitudinal strip of substantially uniform width and being integrally connected to said front curved edge of said front portion of said head covering at a 90° angle and facing downwardly relative to said head covering; and c) closure means connected to opposite ends of said headband at the rear of said headband for adjusting said head bandanna on a wearer's head area in a conforming and secure fit.

2. A head bandanna in accordance with claim 1, wherein the rear portion of said head covering is in the shape of a triangle.

3. A head bandanna in accordance with claim 1, wherein the rear portion of said head covering is in the shape of a square.

4. A head bandanna in accordance with claim 1, wherein the rear portion of said head covering is in the shape of a rectangle.

5. A head bandanna in accordance with claim 1, wherein the rear portion of said head covering is in the shape of a polygon.

6. A head bandanna in accordance with claim 1, wherein the rear portion of said head covering is in the shape of a semicircle.

7. A head bandanna in accordance with claim 1, wherein the rear portion of said head covering is in the shape of a semioval.

8. A head bandanna in accordance with claim 1, wherein the rear portion of said head covering has perimeter edges in the form of a scalloped design.

9. A head bandanna in accordance with claim 1, wherein the rear portion of said head covering has perimeter edges in the form of a triangular serrated design.

10. A head bandanna in accordance with claim 1, wherein the rear portion of said head covering has perimeter edges in the form of a square-toothed design.

11. A head bandanna in accordance with claim 1, wherein the rear portion of said head covering has perimeter edges which have connected thereto a plurality of fringes.

12. A head bandanna in accordance with claim 1, wherein the rear portion of said head covering has perimeter edges which have connected thereto a plurality of tassels.

13. A head bandanna in accordance with claim 1, wherein the rear portion of said head covering has perimeter edges which have connected thereto a plurality of bows.

14. A head bandanna in accordance with claim 1, wherein the rear portion of said head covering has perimeter edges which have connected thereto a plurality of tied and knotted string elements.

15. A head bandanna in accordance with claim 1, wherein said headband engages the forehead when worn and is reinforced with lines of heavy-duty stitching.

16. A head bandanna in accordance with claim 1, wherein said headband is reinforced with a second absorbent material for perspiration absorbency.

17. A head bandanna in accordance with claim 1, wherein said closure means are in the form of hook and loop fastener tabs.

18. A head bandanna in accordance with claim 1, wherein said closure means are in the form of buckle and belt tabs.

19. A head bandanna in accordance with claim 1, wherein said head bandanna is made of cotton, linen, nylon, rayon, silk, polyester, polypropylene, leather, rubber, plastic, or fur materials.

20. A head bandanna in accordance with claim 1, wherein said head bandanna is made of designs of opened-weaved materials, of lace, or of patterned materials.

21. A head bandanna in accordance with claim 1, wherein said head bandanna has printed indicia thereon in the form of corporate and team logos, team and school names, animal caricatures, or movie/TV personalities.

22. A head bandanna in accordance with claim 1, wherein said head covering has an overall length measurement in the range of 15 inches to 21 inches and an overall width measurement in the range of 9 inches to 13 inches.

23. A head bandanna in accordance with claim 1, wherein said head covering has a length measurement of 21 inches and a width measurement of 13 inches.

24. A head bandanna in accordance with claim 1, wherein said headband has an overall length measurement in the range of 15 inches to 30 inches and an overall width measurement in the range of 1 inches to 3 inches.

25. A head bandanna in accordance with claim 1, wherein said headband has a length measurement of 25 inches and a width measurement of 1½ inches.

* * * * *